US005904660A

United States Patent [19]

Kim

[11] Patent Number: 5,904,660

[45] Date of Patent: May 18, 1999

[54] PHYSIOTHERAPY AND HEALTH IMPROVEMENT INSTRUMENT

[76] Inventor: Yeon-Soo Kim, 4-803,Jinju Apt., 20-4, Shinchoen-dong, Seoul, Rep. of Korea, 138-240

[21] Appl. No.: 08/842,117

[22] Filed: Apr. 28, 1997

[51] Int. Cl.[6] ..... A61H 23/02

[52] U.S. Cl. ..... 601/108; 601/49; 601/90

[58] Field of Search ..... 601/24, 49, 51, 601/61, 66, 86, 90, 98, 107–111, 115, 53, 54

[56] References Cited

U.S. PATENT DOCUMENTS

| | | | |
|---|---|---|---|
| 3,424,149 | 1/1969 | Fujimoto | 601/111 |
| 3,777,745 | 12/1973 | Simjian | 601/115 |
| 4,009,710 | 3/1977 | Inada | 601/108 |
| 5,097,823 | 3/1992 | Kempler | 601/111 |

*Primary Examiner*—Danton D. DeMille

*Attorney, Agent, or Firm*—Hazel & Thomas

[57] ABSTRACT

This invention provides a chair type of physiotherapy and health instrument that may be used for the physiotherapy against diseases or health improvement. The instrument has a chair body 10, 100 having a through hole 21, 121 formed at a seat area 20, 120 thereof, an impacting member 30 and a driving unit 40 for driving this member 30, wherein the impacting member 30 pivotally swung can periodically apply an impact on a region to be treated by a user via the through hole 21. Alternatively, the instrument uses, instead of the impacting member, a rotating frictional member 130 resiliently installed to protrude above the through hole 121 and a driving unit 140 for driving this member 130, wherein the member 130 being resiliently contacted with the user's body rotate, thereby being able to apply the frictional stimulus to a user. Therefore, easy access to a user's body is possible even when a user seats on the chair according to the present invention, further providing the physiotherapy or health improvement.

2 Claims, 3 Drawing Sheets

PHYSIOTHERAPY AND HEALTH IMPROVEMENT INSTRUMENT

BACKGROUND OF THE INVENTION

1. Field of the Invention

The present invention relates to a physiotherapy and health improvement instrument, and more particularly to a chair type of physiotherapy and health improvement instrument that can be used for a physical treatment of a perineum, loosened muscles near an inguinal region, a prostate gland, an anus, etc., or for an exercise for health improvement.

2. Description of the Prior Art

As physical treatments available for suppressing the enlargement of the prostate gland, there have been used physical treatments, such as repeated impacts on or frictional stimuli to the prostate gland site. It is known that similar physical treatments are not only helpful to the enlarged prostate, but to a urination difficulty that may be caused by hemorrhoids, calculus or thrombus, or to an abdomen muscle recovery after childbirth. Further, an impact or frictional stimuli on an inguinal region strengthens, for example, the muscles, which provides good effects to aging prevention and stamina improvement.

For the purpose of strengthening the muscles or the muscle recovery, or for the continued physical treatment against the above-mentioned symptoms, such treatments or periodic exercises in the hospital or physiotherapy center, even in their homes or offices, is preferably recommended. However, an area between the anus and the inguinal region gives, unfortunately, inconvenience when the patient himself applies a physical treatment thereto, such as the continued impacts or frictional stimuli, which calls for a mechanical physiotherapy and health improvement instrument which enable the patient to easily apply the physical treatment to himself.

SUMMARY OF THE INVENTION

Therefore, it is an object of the present invention to provide a physiotherapy and a health improvement instrument adapted such that a patient can apply continued impacts on or frictional stimuli to his inguinal region including a perineum.

This invention provides the instrument for accomplishing the above main purpose, which generally includes a chair having a through hole therein, stimulating means for applying the required impacts or frictional stimuli via the through hole, and a driver for the stimulating means.

BRIEF DESCRIPTION OF THE DRAWINGS

Other objects and aspects of the invention will become apparent from the following description of embodiments with reference to the accompanying drawings in which.

DETAILED DESCRIPTION OF THE PREFERRED EMBODIMENT

The preferred embodiment according to the present invention will now be described in detail in accordance with the accompanying 7 drawings.

Figure 2:
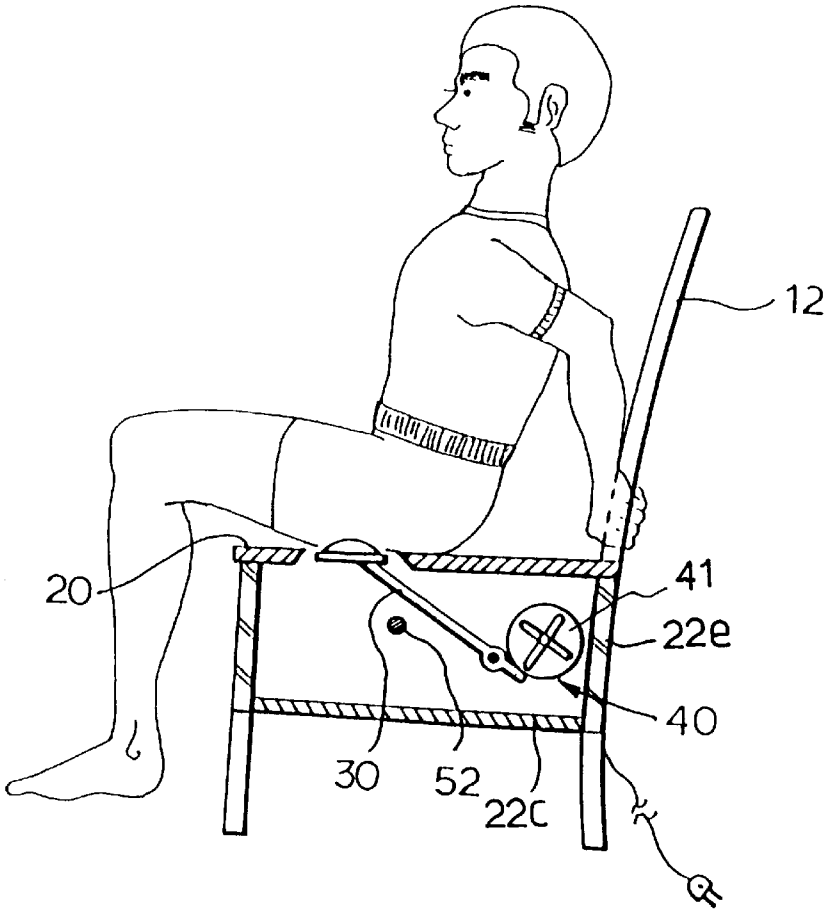
FIG. 2 shows a side sectional view as seen in a state in the user of the instrument of the present invention.
Figure 1:
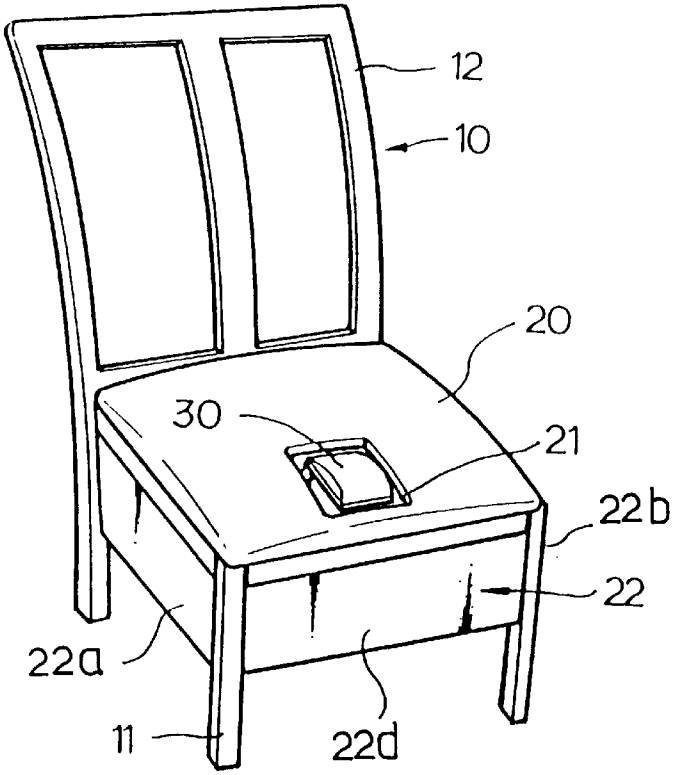
FIG. 1 shows a perspective view of a physiotherapy and health improvement instrument in accordance with a first embodiment of the present invention.
Figure 3:
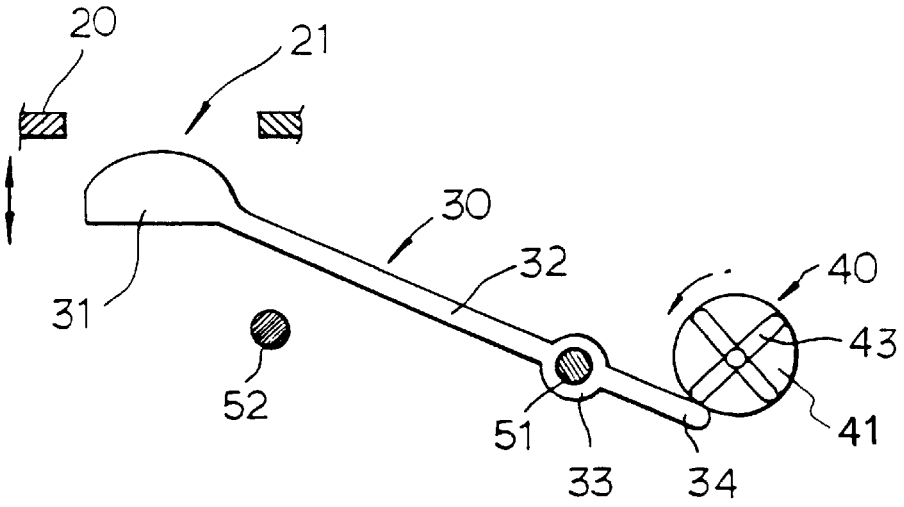
FIG. 3 shows a detailed main parts constituting the instrument in accordance with the first embodiment of the present invention.

FIGS. 1 through 3 illustrate a physiotherapy and health instrument in accordance with one preferred embodiment of the present invention. In a first preferred embodiment thus illustrated, the physiotherapy and health improvement instrument employing an impacting treatment is of, as shown in FIG. 1, the chair-like type, allowing the patient to sit on the chair and to apply the self-treatment.

The instrument according to the present invention includes, as shown in FIG. 2, a main body 10 including a seat area having a through hole 21 therein, an impacting member 30 which is moved up or down via the through hole 21, and a driving unit 40 for driving the impacting member 30 to upwardly or downwardly move it.

For the convenience of the illustration, the body 10 is shown as, for example, a dining chair, but not limited thereto, any types of members suitable for taking a seat can be used. It is noted that the through hole 21 is preferably formed in the seat area 20 such that an area between the inguinal region and the anus corresponds to the through hole 21. As shown in FIG. 1, the body 10 is provided around lower part relative to the seat area 20 with a box-like case 22 assembled or integrally formed thereto, in which the case 22 is to accommodate the impacting member to be later described and the driving unit 40 therein and to support them, and has side plates 22*a*, 22*b*, a bottom plate 22*c*, and a front plate 22*d*, and a rear plate 22*e* which form the case 22, but all or any of these plates being selectively employed in forming the case 22. Any one of said plates 22*a* to 22*e* may have a manipulating unit(not shown) which includes a power switch for energizing the driving unit 40 to be described below, an instrument panel, etc. But, it is apparent that the manipulating unit may be installed into an armrest (not shown) of the body 10, or a back 12 of the body 10.

Referring to FIG. 2, the impacting member 30 hits via the through hole 21 of the seat zone 20 the inguinal region of the patient who sits in the chair. As shown in FIG. 3 in more detail, the impacting member 30 has a contacting portion 31 having a convex upper surface thereof, an arm 32 extended from the contacting portion 21, a pivotal hole 33 formed at one end of the arm 32, and extension 34 prolonged in a direction opposite to the arm 32, which are integrally formed. The contacting portion 31 is provided for applying the impact on the inguinal region, etc., various shapes of which may be taken depending upon its usage as far as the portion 31 has at least one protrusion. The arm 32 is extended from the contacting portion 31, and its length is appropriately defined to outwardly protrude from the surface of the seat zone 20 so as to apply the proper impact to a user, under the consideration of the dimensions of the case 22 and seat zone 20. At one end of the arm 31 is formed the pivotal hole 33 into which a shaft 51 fixed into the body is inserted such that the impacting member can be free to rotate around the shaft. The extension 34 which is prolonged opposed to the arm 32 brings into contact with a cam 41 to be described below in order to up and down swing the impacting member 30, with the centered pivotal hole 33 in its motion.

Meanwhile, a stopper bar 52 is additionally installed parallel to the shaft 51 in order to limit the excursion range in the swing motion of the impacting member 30. The stopper bar 52 confines a downward swing range of the impacting member 30 only to any predetermined position so as to prevent the impacting member 30 from being separated from the cam 41. The shaft 51 and stopper bar 52 are fixedly installed onto, for example, two side plates 22*a*, 22*b*.

The driving unit 40 consists of a motor and decelerator (not shown), and a cam 41, and serves as driving means for ascending and descending the impacting member 30 through the use of the cam 41. It is advantageous to employ the motor whose revolution number can be adjusted, whereby the revolution number of the motor may be appropriately decelerated to, for example, 50 to 400 rpm, so that the cam 41 rotates under the decelerated speed. The cam 40 is circularly configured to have at least one protrusion 43 thereon, which is positioned such that the protrusion 43 is overlapped with the extension 34 of the impacting member 30 on the coplanar level from each other. Accordingly, as the cam 31 rotates, the protrusion 43 periodically, downwardly pushes the extension 34 to pivotally and upwardly swing the impacting member 30. While the protrusion 43 of the cam 41, being in contact with the extension 34, rotates, the impacting member 30 can lift up, thereby to hit any place of the human body. Subsequently, if the swing motion of the extension 34 allows the protrusion 43 to pass through the end portion of the extension 34 and then to be separated from it, the impacting member 30 can pivotally swing in an opposite direction(in drawing, shown in a downward direction) by the weight of the impacting member 30, reach the stopper bar 52 and then stop at there. The rotation of the cam 41 allows the next protrusion 43 and extension 34 to bring into contact with each other. This action periodically continues to repeat.

Figure 4:
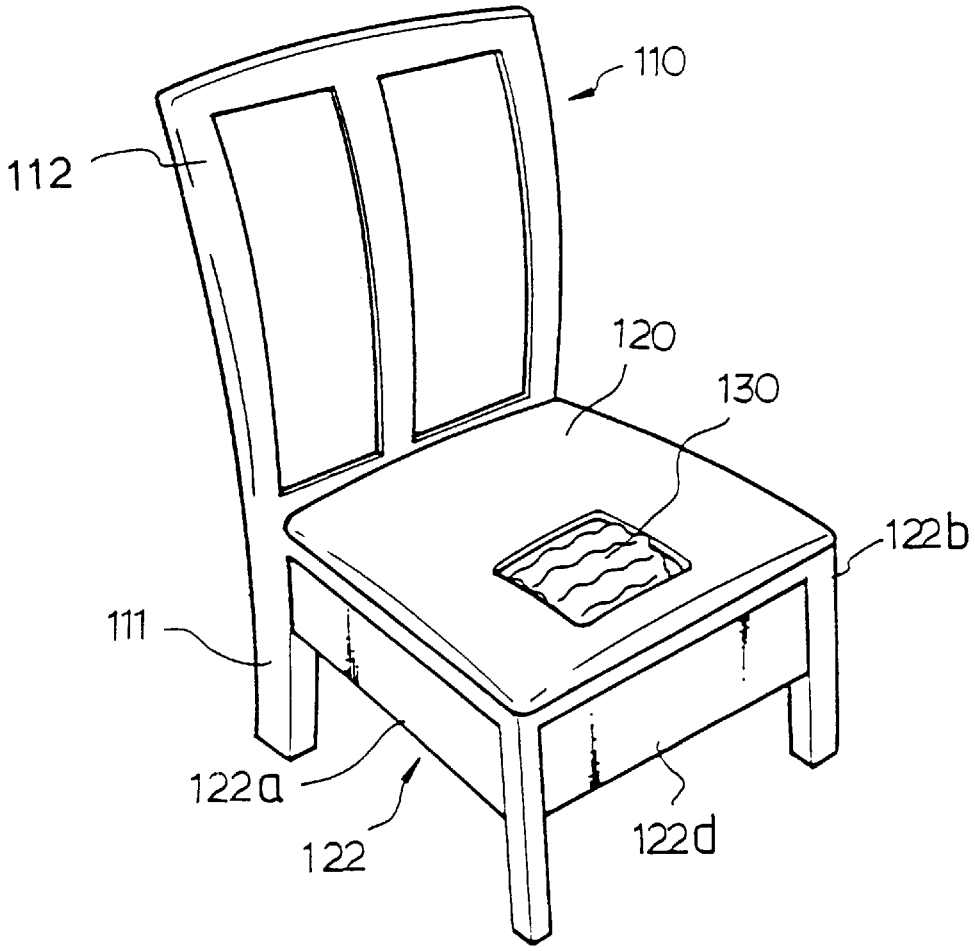
FIG. 4 shows a perspective view of the instrument in accordance with a second embodiment of the present invention.
Figure 5:
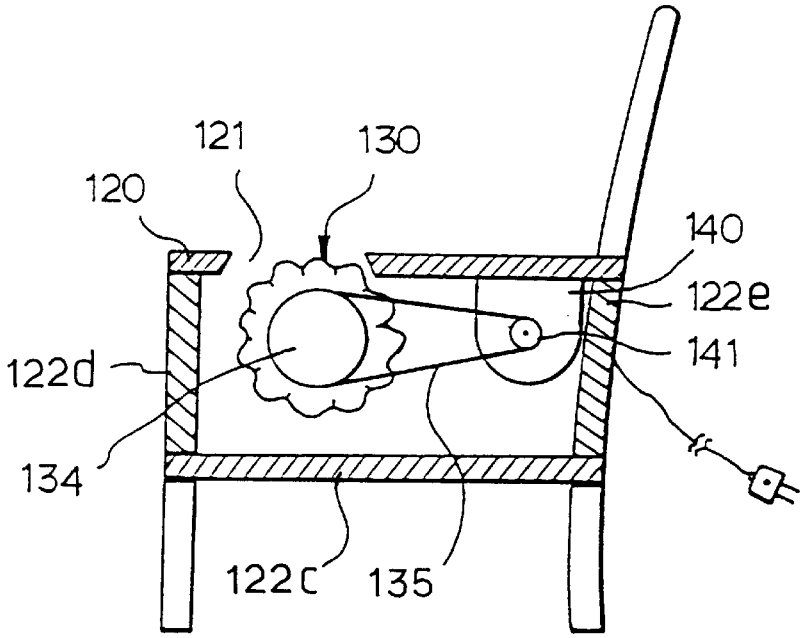
FIG. 5 shows a side sectional view of the instrument in FIG. 4; and Each of FIGS. 6(*a*) and 6(*b*) shows a front view of a rotating frictional member in accordance with the second embodiment of the present invention.
Figure 6A:
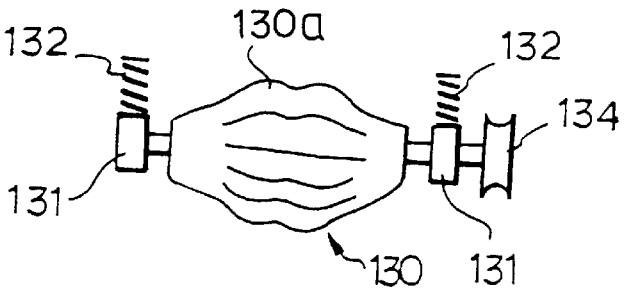
Figure 6B:
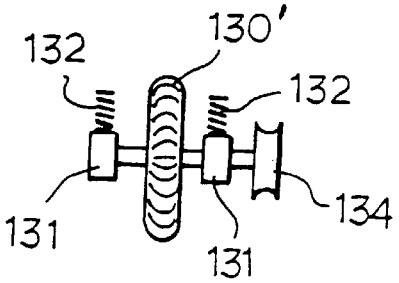

A second preferred embodiment of the present invention is shown in FIGS. 4 to 6. The second embodiment provides a physiotherapy and health improvement instrument employing a frictional stimulus mechanism, whose 25 action includes applying the frictional stimulus to an area between the inguinal region and the anus including the perineum by means of a rotating roller.

As shown in FIG. 4, a frictional type of physiotherapy and health improvement instrument has a chair body 100 including a seat area 120 having a through hole 121 therein, a rotating frictional and elastic member 130 raised beyond the surface of the seat area 120, and a driving unit 140 for driving the rotating frictional member 130.

Any types of the chair body 100 may be used as in the first embodiment body 10. It is noted that the through hole 121 is preferably formed in the seat area 120 such that an area between the inguinal region and the anus corresponds to the through hole 121. As in the first embodiment, the body 100 is provided around lower part, including legs 111, relative to the seat area 20 with a box-like case 122 assembled or integrally formed thereto, in which the case 122 has side plates 122*a*, 122*b*, a bottom plate 122*c*, and a front plate 122*d*, and a rear plate 122*e* which form the case 122, but all or any of these plates being selectively employed in forming the case 122. Any one of the case 122, an armrest(not shown) of the body 100, or a back 112 of the body 100 may have a manipulating unit(not shown) which includes a power switch used in energizing the driving unit.

The rotating frictional member 130 for applying the frictional stimulus to a selected portion of the human body has an outer rough surface to be in contact with the human body as a rough surface 130*a* such that a repeated, periodic strength and weakness in a frictional force is provided, for example, this being shown in FIGS. 6(*a*) and 6(*b*) as a cylindrical body having a convex center portion and a circular body, respectively. The rotating frictional member 130 is installed such that some portion of the member 130 protrudes above the surface of the seat area 120 from the through hole 121. Both ends of a rotating shaft 151, which are fixedly installed along a longitudinal direction of the rotating frictional member 130, have each boss 131 that is elastically fixed into the side plates 122*a*, 122*b*, or bottom plate 122*c* of the case 122, or the seat area 120 by means of a spring 132. Accordingly, if a user seats on the seat area 120 of the chair, the rotating frictional member 130 protruded above the seat area 120 is forcedly pushed inside the through hole 121, resulting in the compression of the spring 132 having been elastically supporting the member 130. Then, the resilient force of the spring 132 causes the rotating frictional member 130 to be closely in contact with the region of a user to be treated, with an appropriate pressure.

The rotating frictional member 130 have a pulley 134 fixedly installed at one end of the rotating shaft 151. This pulley 134 is positioned in the coplanar relationship relative to a rotating pulley 141 of a driving unit 140, and is driven by means of a belt 135, etc.

The driving unit 140 includes a motor and a rotating pulley 141, or a combination of them and a decelerator, wherein the motor or a motor assembly whose revolution number can adjustably be set is preferable.

According to the foregoing instrument of the present invention, when a user sits on the seat area 120 such that his or her specific region to be treated is in contact with the rotating frictional member 130 protruded above the through hole 121 of the seat area 120, and operates the instrument, the instrument gives a massage effect by the periodic, strong frictional force which is produced by the rough surface 130*a* formed on the outer surface of the member 130 and is applied to the specific region of the human body, while the rotating frictional member 130 being elastically in contact with the human body is rotating.

The present invention provides an advantage of an impact or massage action for the selected inguinal region of the human body in convenience through a simple manipulation of the manipulation portion with a user being seated on the chair of the present invention for the purpose of the physiotherapy against hemorrhoids, or urination-related diseases, such as the enlargement of the prostate gland, as well as caring of health after childbirth, further health improvement.

One skilled in the art will appreciate that various modifications are possible, without departing from the scope and spirit of the invention.

What is claimed is:

1. A physiotherapy and health instrument comprising:

a chair having a through hole formed at a seat zone;

stimulating means for applying the required impacts or frictional stimulus via the through hole;

a driver for the stimulating means;

wherein the stimulating means comprises:

an impacting member 30 integrally formed with a contacting portion 31 having a convex upper surface thereof;

an arm extending from the contact portion 31;

a pivotal hole 33 formed at one end of the arm 32 and into which a shaft 51 fixed into a body 10 of the chair is inserted such that the impacting member 30 can be free to rotate around the shaft; and an extension 34 prolonged in a direction opposite to the arm 32,; and wherein the driver comprises:

a cam 41 having at least one protrusion 43, and wherein the protrusion 43 of the cam 41 overlaps the extension 34 of the impacting member 30 in a coplanar relationship from each other, whereby when the cam 41 rotates, the protrusion 43 downwardly pushes the extension 34 to rotate the impacting member 30 about the pivotal hole 33 and thereby to lift up the contacting portion 31.

2. A physiotherapy and health instrument comprising:

a chair having a through hole formed at a seat zone;

stimulating means for applying the required impacts or frictional stimulus via the through hole; and a driver for the stimulating means, wherein:

the stimulating means comprises:

an impacting member 30 integrally formed with a contacting portion 31 having a convex upper surface thereof;

an arm extending from the contact portion 31;

a pivotal hole 33 formed at one end of the arm 32 and into which a shaft 51 fixed into a body 10 of the chair is inserted such that the impacting member 30 can be free to rotate around the shaft; and an extension 34 prolonged in a direction opposite to the arm 32; and wherein the driver comprises:

a cam 41 having at least one protrusion 43, and wherein the protrusion 43 of the cam 41 overlaps the extension 34 of the impacting member 30 in a coplanar relationship from each other, whereby when the cam 41 rotates, the protrusion 43 downwardly pushes the extension 34 to rotate the impacting member 30 about the pivotal hole 33 and thereby to lift up the contacting portion 31; and wherein a stopper bar 52 is installed parallel to the shaft 51 and below the impacting member 30, such that when the impacting member 30 is separated from the protrusion 43 of the cam 41 and descends, said member 30 continues to impact without separating from the cam 41.

* * * * *